US006971378B2

(12) United States Patent
Mackey et al.

(10) Patent No.: US 6,971,378 B2
(45) Date of Patent: Dec. 6, 2005

(54) CYLINDER HEAD HAVING AN INTERNAL EXHAUST GAS RECIRCULATION PASSAGE

(75) Inventors: Jason Mackey, Taylorsville, IN (US); Ryo Fuchinoue, Columbus, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 10/170,527

(22) Filed: Jun. 13, 2002

(65) Prior Publication Data

US 2003/0230290 A1 Dec. 18, 2003

(51) Int. Cl.[7] ..... F02M 25/07
(52) U.S. Cl. ..... 123/568.13; 123/568.12
(58) Field of Search ..... 123/568.12, 568.13, 123/568.11, 568.17, 41.82 R, 193.5

(56) References Cited

U.S. PATENT DOCUMENTS

| | | | | |
|---|---|---|---|---|
| 1,384,133 | A | | 7/1921 | Howe |
| 3,799,131 | A | | 3/1974 | Bolton |
| 4,072,133 | A | | 2/1978 | McWhirter |
| 4,106,449 | A | | 8/1978 | Matsumoto et al. |
| 4,147,031 | A | | 4/1979 | Tanuma et al. |
| 4,192,140 | A | | 3/1980 | Yamashita et al. |
| 4,194,474 | A | | 3/1980 | Endo |
| 4,201,165 | A | | 5/1980 | Tanaka et al. |
| 4,221,203 | A | | 9/1980 | Hayashi et al. |
| 4,231,339 | A | | 11/1980 | Matsumoto et al. |
| 4,237,828 | A | | 12/1980 | Sugiyama et al. |
| 4,258,687 | A | | 3/1981 | Mauch et al. |
| 4,267,812 | A | | 5/1981 | Aula et al. |
| 4,323,045 | A | | 4/1982 | Yamashita |
| 4,367,719 | A | | 1/1983 | Kimura et al. |
| 4,413,605 | A | | 11/1983 | Leoni |
| 4,414,953 | A | | 11/1983 | Matsumoto et al. |
| 4,579,091 | A | * | 4/1986 | Kashiwagi et al. ... 123/41.82 R |
| 4,782,797 | A | | 11/1988 | Kurahashi |
| 4,811,697 | A | | 3/1989 | Kurahashi |
| 4,867,109 | A | | 9/1989 | Tezuka et al. |
| 5,329,912 | A | | 7/1994 | Matsumoto et al. |
| 5,490,488 | A | | 2/1996 | Aversa et al. |
| 5,690,081 | A | | 11/1997 | Kwiatkowski |
| 5,690,082 | A | | 11/1997 | Tanioka et al. |
| 5,839,417 | A | * | 11/1998 | Kwiatkowski et al. . 123/568.13 |
| 5,931,131 | A | | 8/1999 | Hackett |
| 5,957,116 | A | | 9/1999 | Haegele et al. |
| 6,009,709 | A | | 1/2000 | Bailey |
| 6,478,017 | B2 | * | 11/2002 | Bianchi ..... 123/568.12 |

FOREIGN PATENT DOCUMENTS

| | | |
|---|---|---|
| JP | 54113721 | 9/1979 |
| JP | 54150512 | 11/1979 |
| JP | 3-92515 | 9/1991 |

* cited by examiner

*Primary Examiner*—Henry C. Yuen
*Assistant Examiner*—Hyder Ali
(74) *Attorney, Agent, or Firm*—Barnes & Thornburg

(57) ABSTRACT

The present invention relates to an internal combustion engine cylinder head having an exhaust gas recirculation passage formed therein. The exhaust gas recirculation passage extending along the length of the cylinder head casting and disposed in a heat transfer relationship with a water jacket located within the cylinder head. One form of the present invention includes heat transfer members within the passage to increase the heat transfer between the exhaust gas flowing in the passage and the cylinder head.

22 Claims, 12 Drawing Sheets

CYLINDER HEAD HAVING AN INTERNAL EXHAUST GAS RECIRCULATION PASSAGE

BACKGROUND OF THE INVENTION

The present invention generally relates to the field of internal combustion engines, and more specifically to an internal combustion engine having a cylinder head with an exhaust gas recirculation passage therein for routing exhaust gas back into the intake of the engine.

Environmental concerns about the discharge of combustion by-products into the atmosphere have casused many engine designers to focus on minimizing the discharge of certain materials from the engine. One by-product of concern are Nitrogen Oxides (hereinafter $NO_X$), a gas, which is formed during the combustion cycle of the internal combustion engine. The degree of $NO_X$ gas formed during the combustion cycle is related to the temperature of the exhaust gas within the engine's combustion chamber. Consequently, in order to reduce the quantity of $NO_X$ gas formed during the combustion cycle exhaust gas recirculation systems were developed. A typical exhaust gas recirculation system includes directing a portion of the exhaust gas from the combustion chambers through the intake manifold and back into the combustion chambers. As a result, the temperature of the exhaust gas within the combustion chambers is lowered to thereby reduce the formation of $NO_X$ gas.

The automotive industry is continually striving to improve the performance of the exhaust gas recirculation systems and to minimize the amount of space needed for the exhaust gas recirculation system. The present invention contributes to the advancements in the field of exhaust gas recirculation systems in a novel and unobvious manner.

SUMMARY

The present invention is a cylinder head having an internal exhaust gas recirculation passage. Various aspects of the present invention are novel, non-obvious, and provide various advantages. While the actual nature of the present invention described in detail herein can only be determined with reference to the claims appended hereto, certain features which are characteristic of the present invention disclosed herein can be described briefly.

One form of the present invention contemplates an apparatus, comprising: a cast cylinder head for a multi-cylinder internal combustion engine having an internal water jacket and a first longitudinal axis extending from a first end of the cylinder head to a second end of the cylinder head, the cylinder head having an intake passage system formed in the cylinder head for the delivery of a gas to each combustion chamber defined in the cylinder head and an exhaust passage system formed in the cylinder head for the passage of an exhaust gas from each of the combustion chambers; and, an exhaust gas recirculation passage formed within the cylinder head and having an inlet proximate the first end of the cylinder head for receiving a portion of the exhaust gas and an outlet proximate the second end of the cylinder head in flow communication with the intake passage system, the exhaust gas recirculation passage having a first passage portion extending along the internal water jacket between the first end of the cylinder head and the second end of the cylinder head and substantially parallel with the longitudinal axis, and the first passage portion is disposed in a heat transfer relationship with the internal water jacket.

A second form of the present invention contemplates a cylinder head, comprising: a cast metallic body member for a multi-cylinder internal combustion engine having an internal water jacket and a first longitudinal axis extending from a first end of the body member to a second end of the body member, the body member having an intake passage system formed in the body member for the delivery of a gas to each combustion chamber defined in a bottom side of the body member and an exhaust passage system formed in the body member for the passage of an exhaust gas from each of the combustion chambers; and, exhaust gas recirculation means formed within the body member head for delivery of a portion of the exhaust gas to the intake passage system.

One object of the present invention is to provide a unique cylinder head comprising an exhaust gas recirculation passage.

Further objects, features, advantages and aspects of the present invention shall become apparent from the detailed drawings and description contained herein.

DETAILED DESCRIPTION OF SELECTED EMBODIMENTS

Figure 1A:
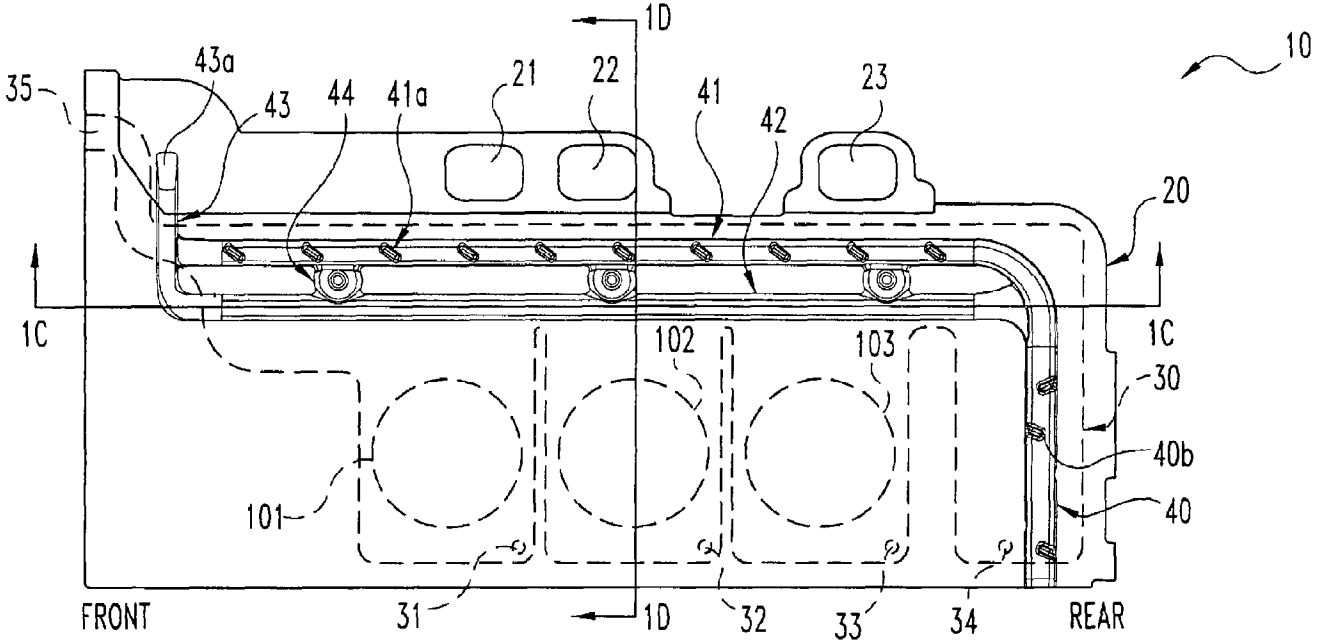
FIG. 1A is an illustrative side elevational view of an internal combustion engine comprising a cylinder head with a gas recirculation passage according to one form of the present invention.
Figure 1B:
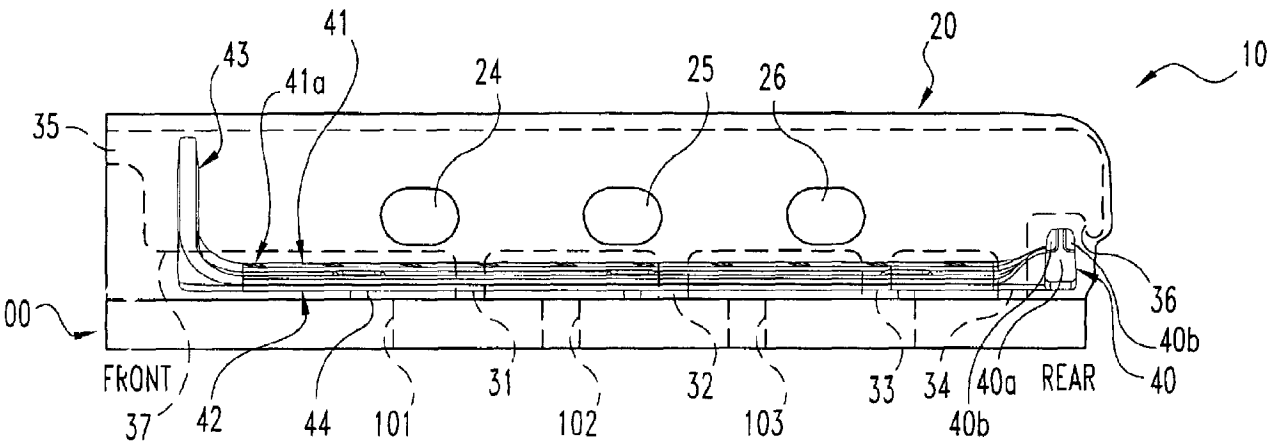
FIG. 1B is an illustrative side view of the cylinder head comprising a portion of the FIG. 1A internal combustion engine.
Figure 1C:
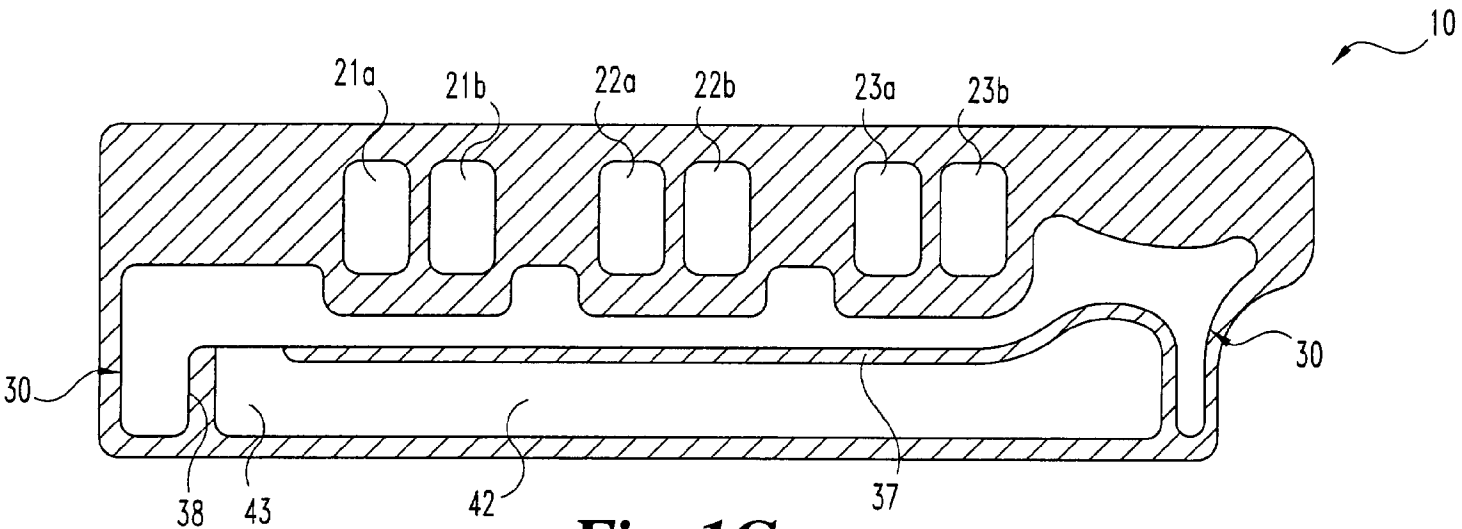
FIG. 1C is a cross-sectional view of the cylinder head of FIG. 1A taken along line 1C—1C of FIG. 1A.
Figure 1D:
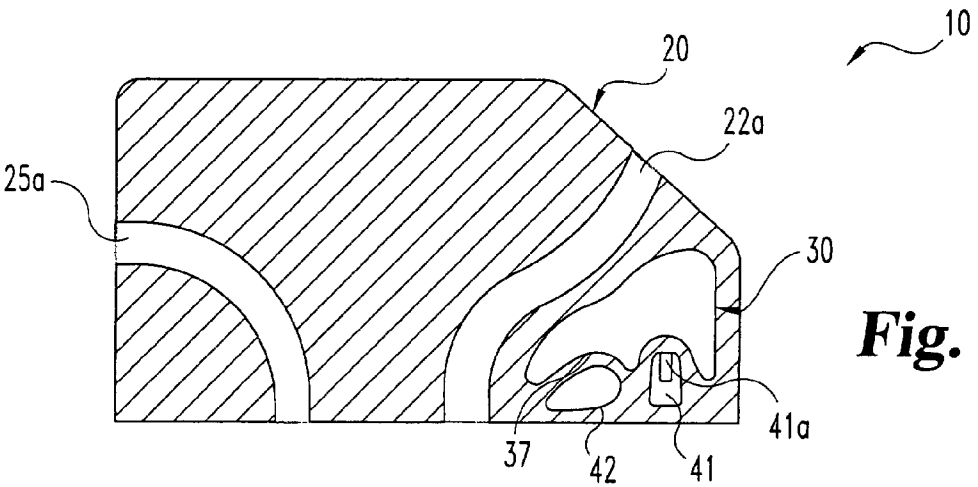
FIG. 1D is a cross-sectional view of the cylinder head of FIG. 1A taken along line 1D—1D of FIG. 1A.
Figure 2A:
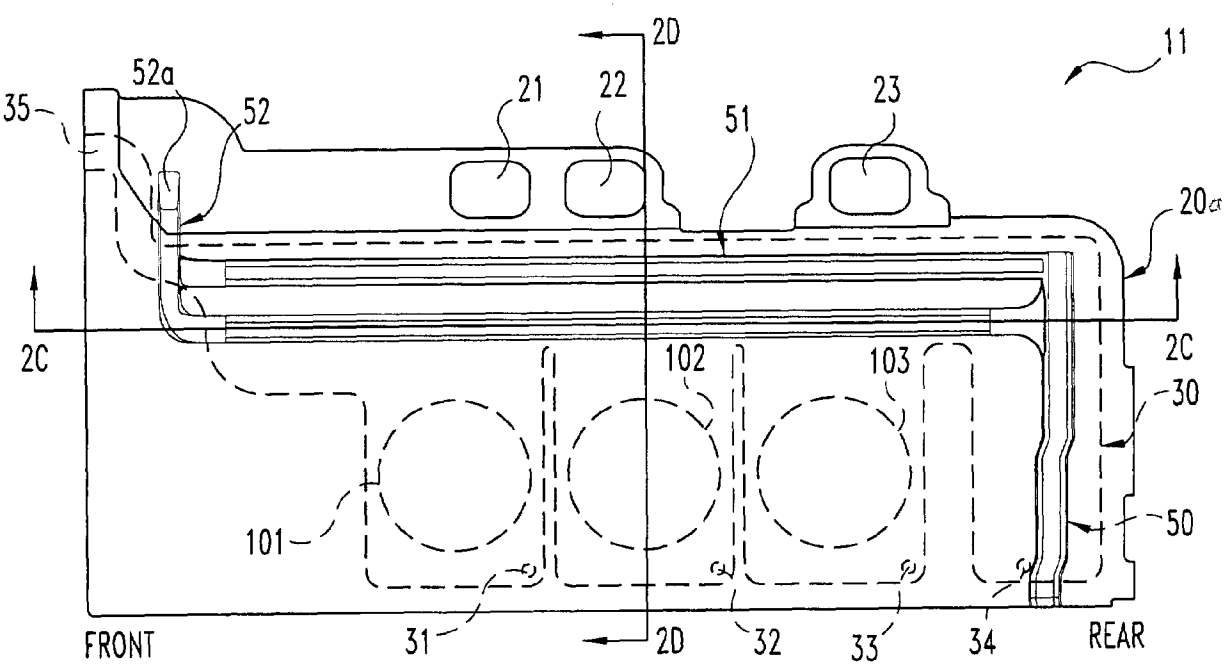
FIG. 2A is an illustrative side elevational view of an internal combustion engine comprising a cylinder head with a gas recirculation passage according to another form of the present invention.
Figure 2B:
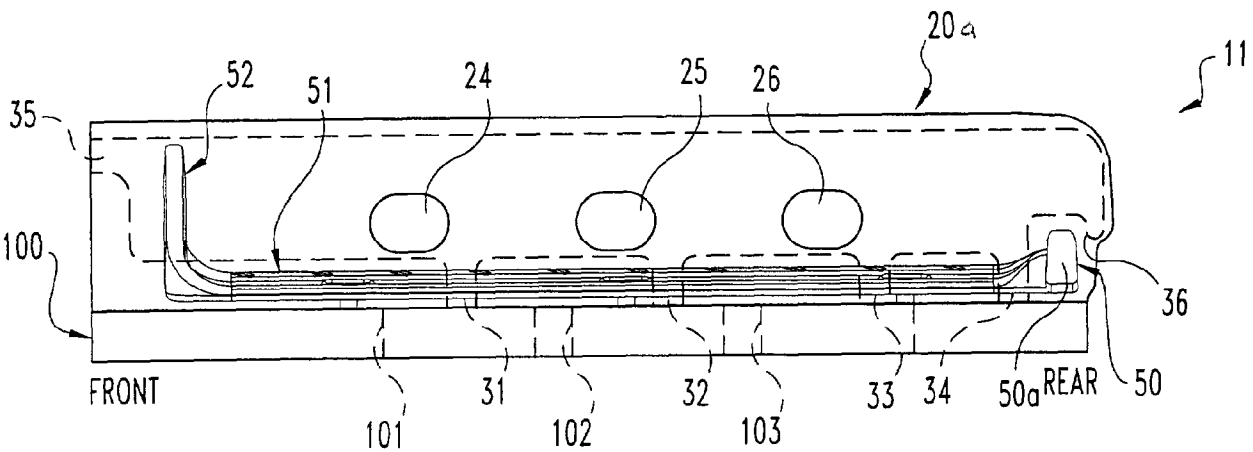
FIG. 2B is an illustrative side view of the cylinder head comprising a portion of the FIG. 2A internal combustion engine.
Figure 2C:
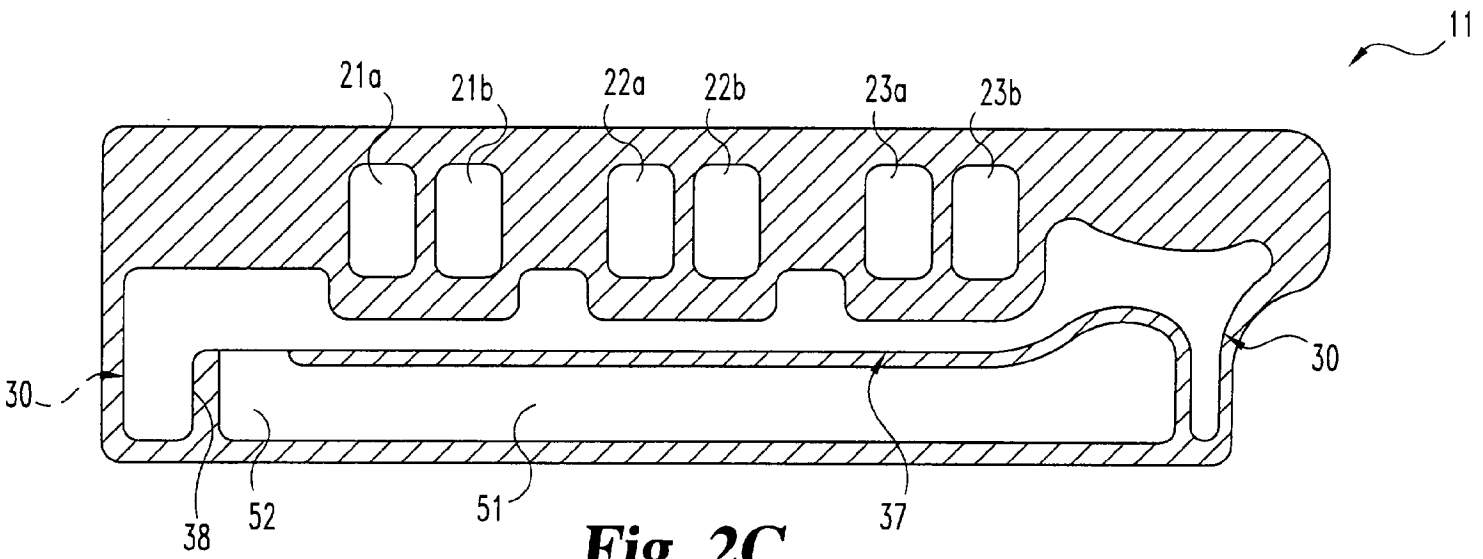
FIG. 2C is a cross-sectional view of the cylinder head of FIG. 2A taken along line 2C—2C of FIG. 2A.
Figure 2D:
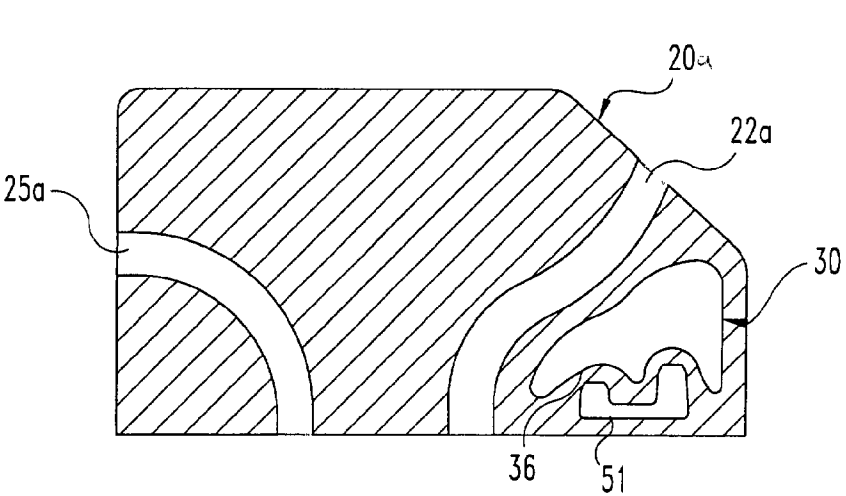
FIG. 2D is a cross-sectional view of the cylinder head of FIG. 2A taken along line 2D—2D of FIG. 2A.
Figure 3A:
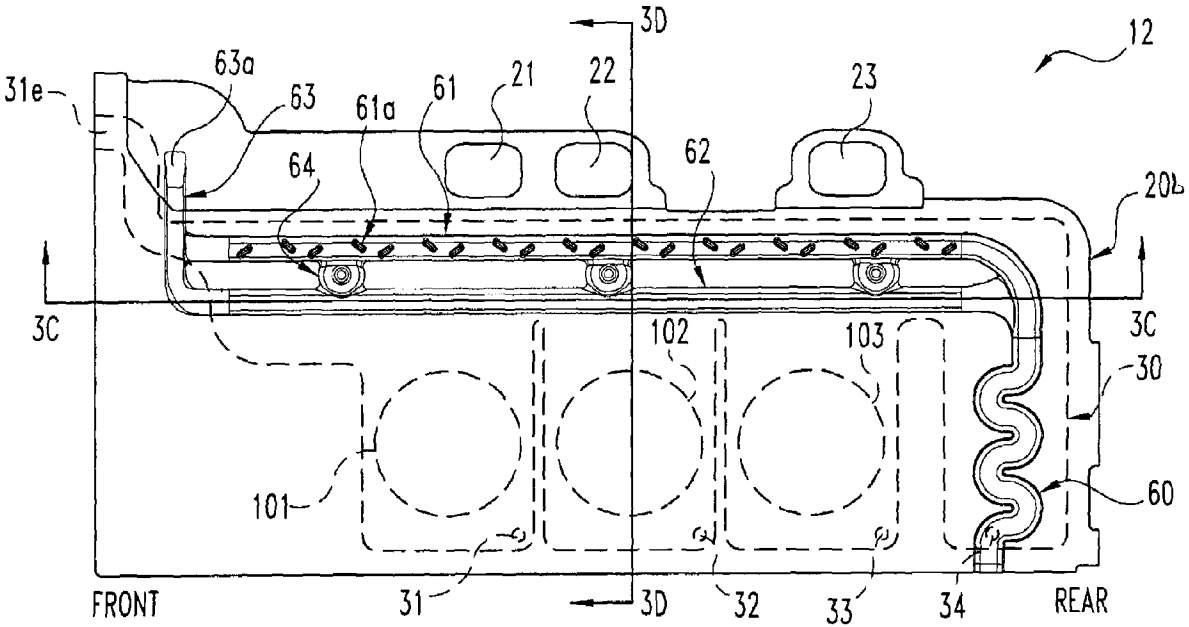
FIG. 3A is an illustrative side elevational view of an internal combustion engine comprising a cylinder head with a gas recirculation passage according to another form of the present invention.
Figure 3B:
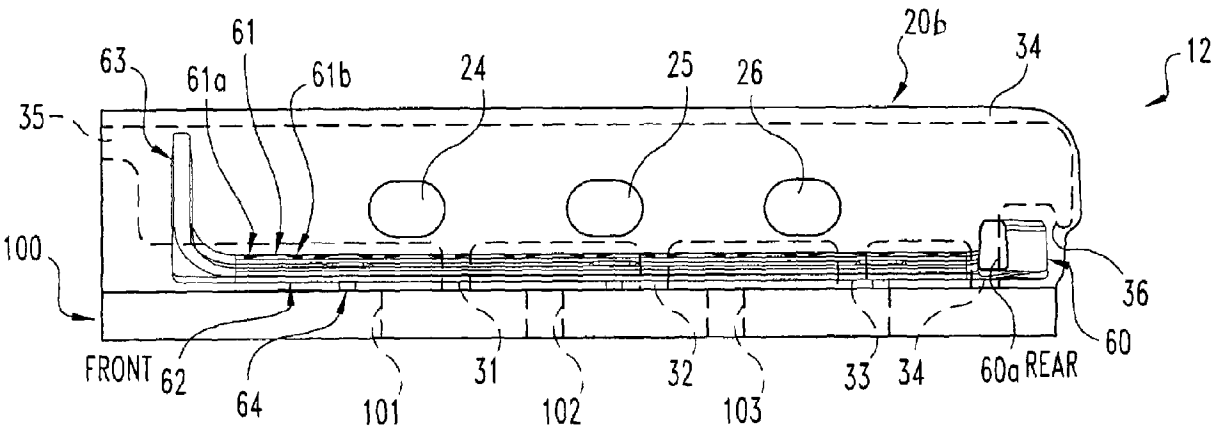
FIG. 3B is an illustrative side view of the cylinder head comprising a portion of the FIG. 3A internal combustion engine.
Figure 3C:
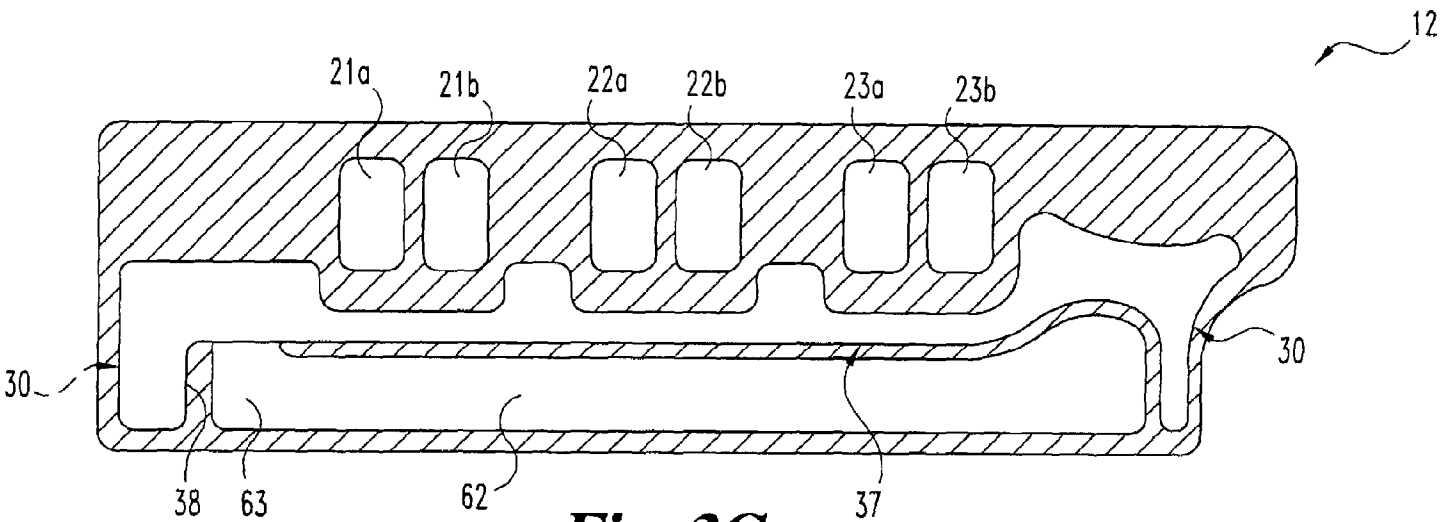
FIG. 3C is a cross-sectional view of the cylinder head of FIG. 3A taken along line 3C—3C of FIG. 3A.
Figure 3D:
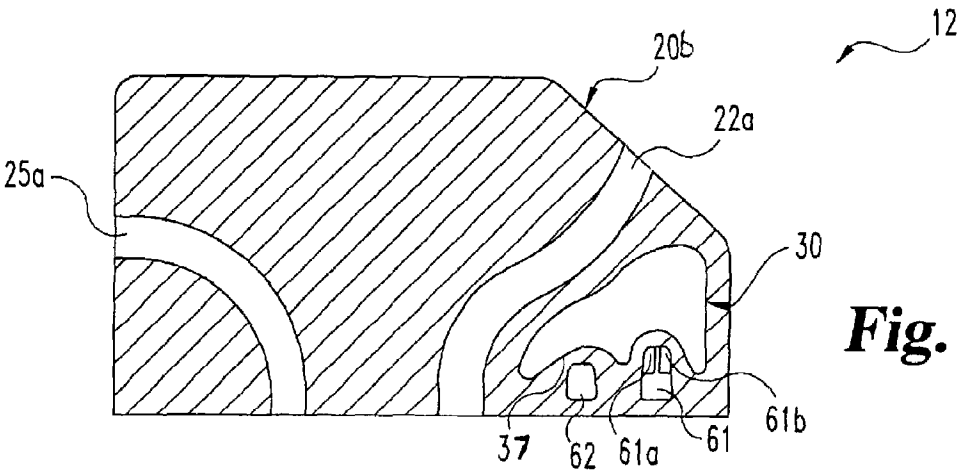
FIG. 3D is a cross-sectional view of the cylinder head of FIG. 3A taken along line 3D—3D of FIG. 3A.
Figure 4A:
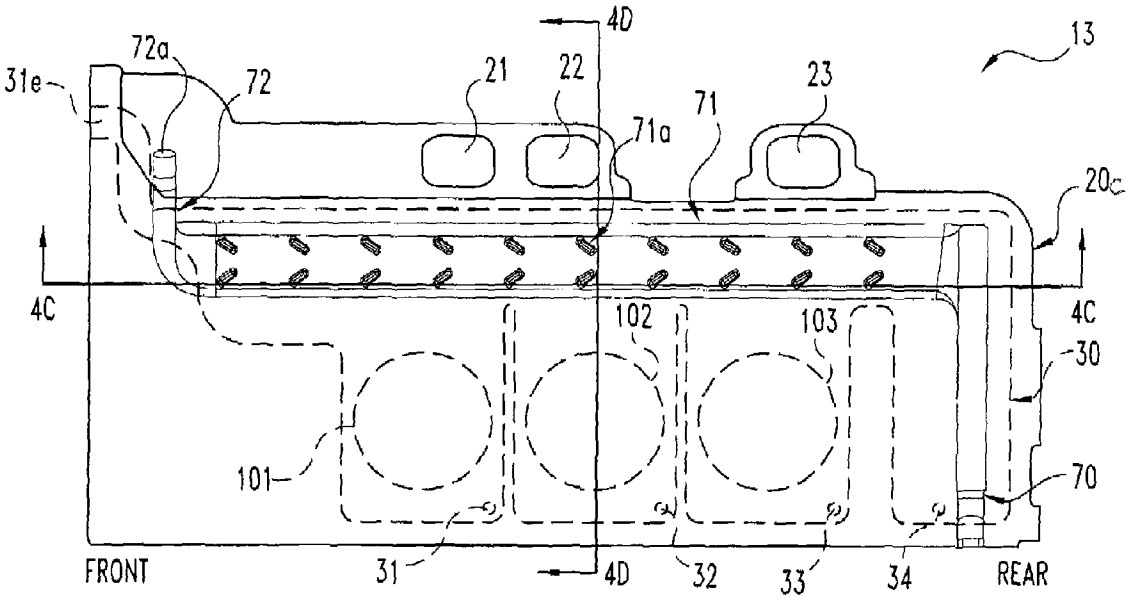
FIG. 4A is an illustrative side elevational view of an internal combustion engine comprising a cylinder head with a gas recirculation passage according to another form of the present invention.
Figure 4B:
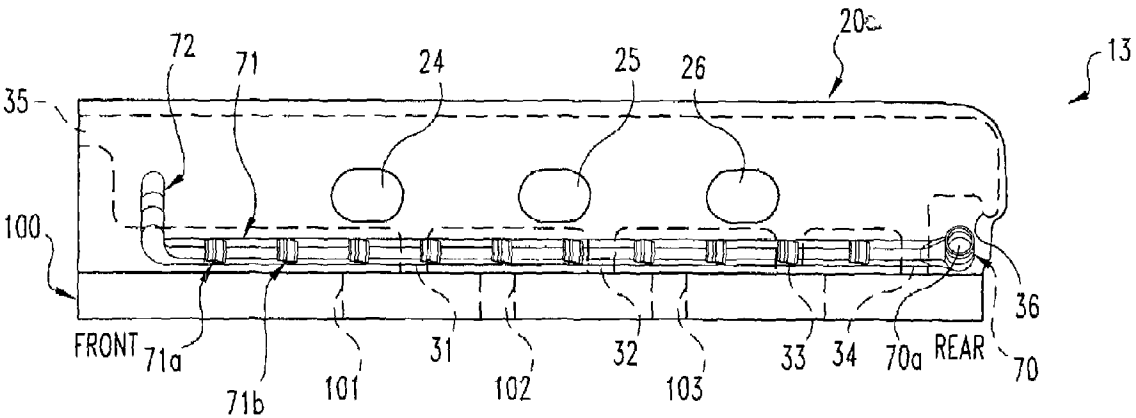
FIG. 4B is an illustrative bottom side view of the cylinder head comprising a portion of the FIG. 4A internal combustion engine.
Figure 4C:
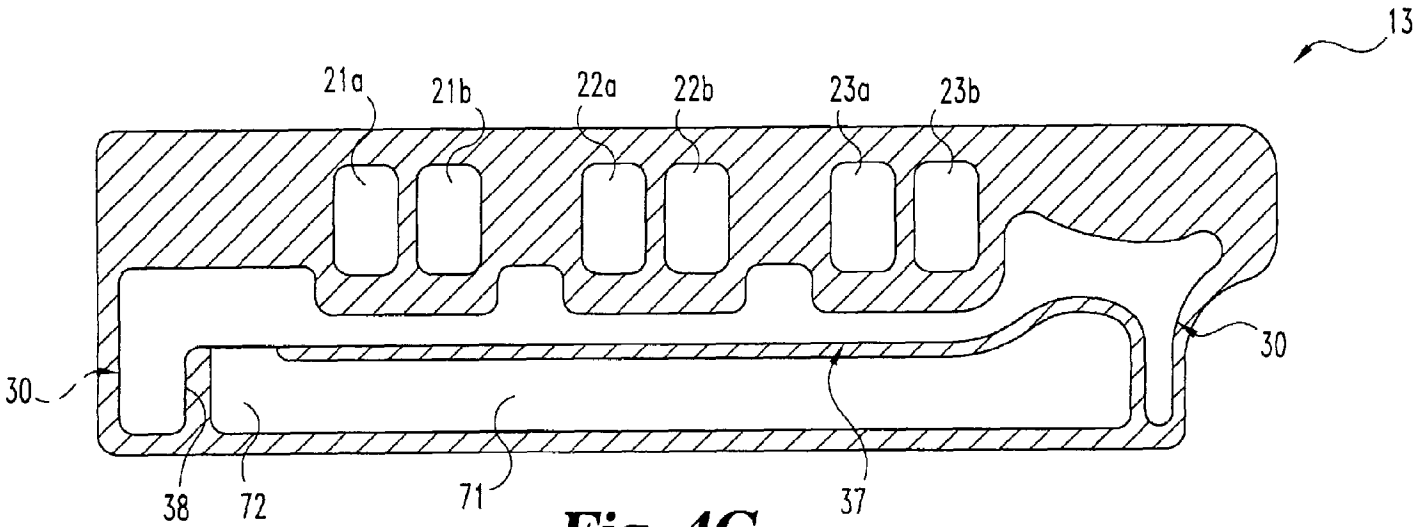
FIG. 4C is a cross-sectional view of the cylinder head of FIG. 4A taken along line 4C—4C of FIG. 4A.
Figure 4D:
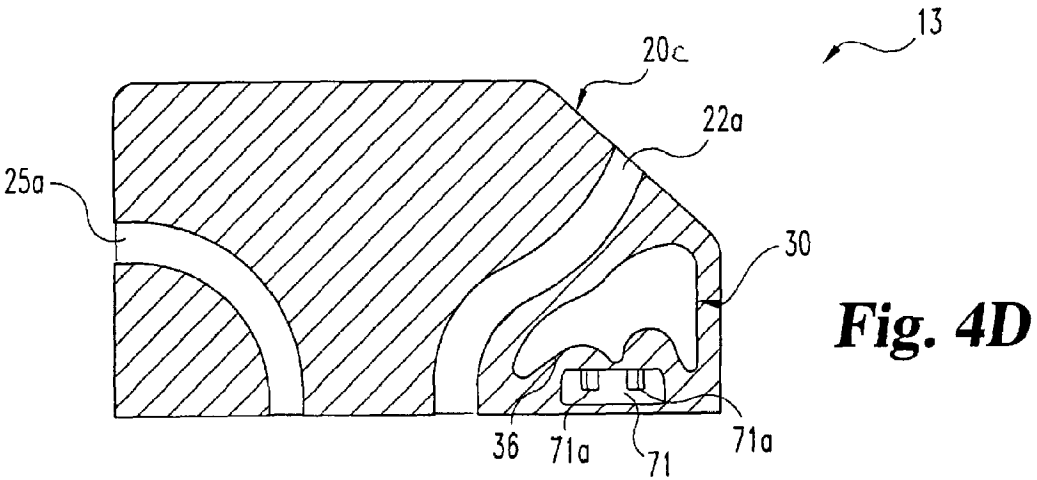
FIG. 4D is a cross-sectional view of the cylinder head of FIG. 4A taken along line 4D—4D of FIG. 4A.
Figure 5A:
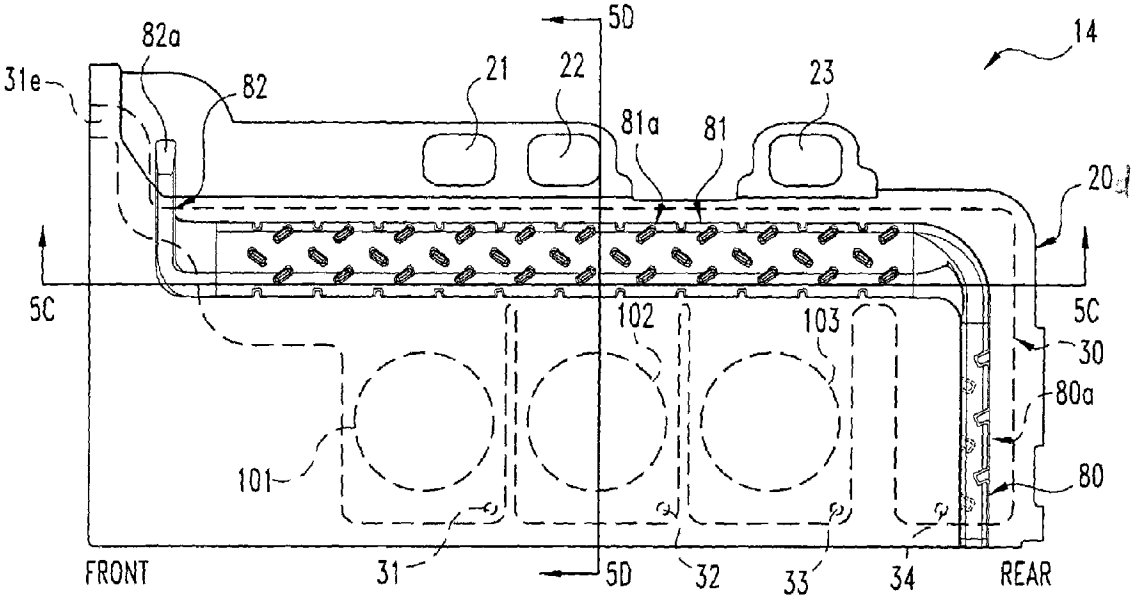
FIG. 5A is an illustrative side elevational view of an internal combustion engine comprising a cylinder head with a gas recirculation passage according to another form of the present invention.
Figure 5B:
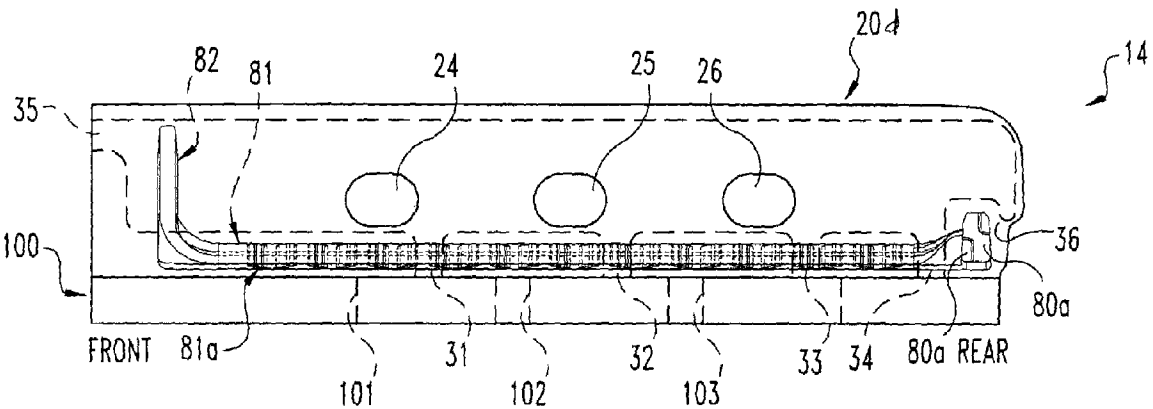
FIG. 5B is an illustrative side view of the cylinder head comprising a portion of the FIG. 5A internal combustion engine.
Figure 5C:
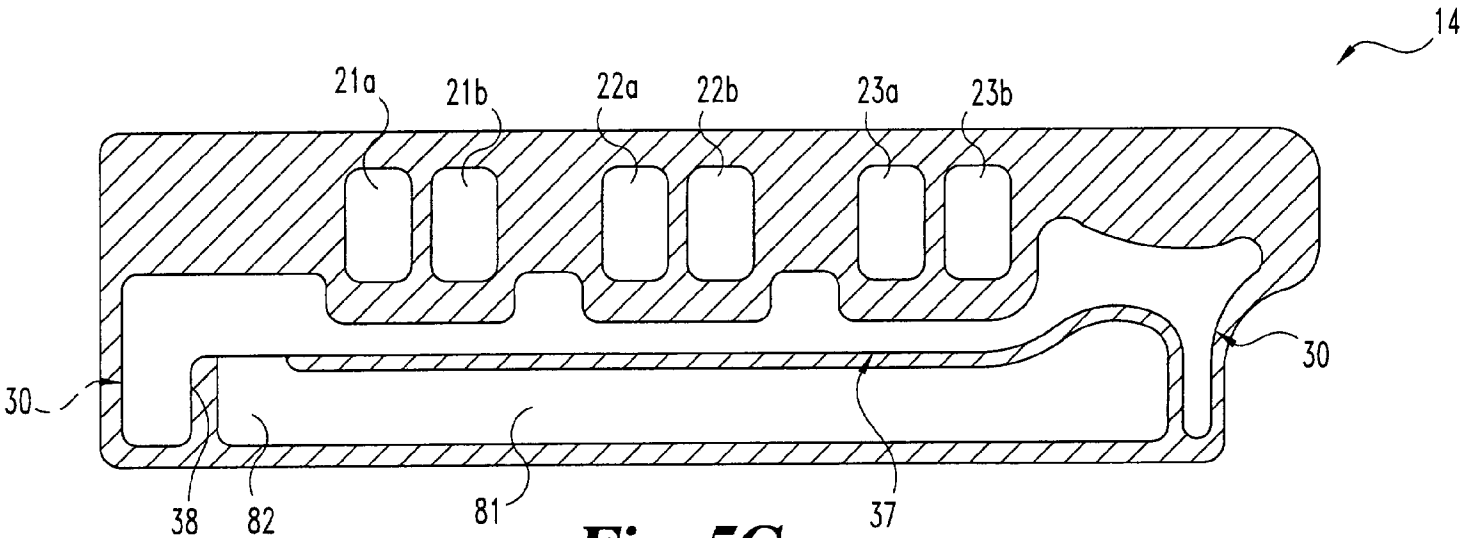
FIG. 5C is a cross-sectional view of the cylinder head of FIG. 5A taken along line 5C—5C of FIG. 5A.
Figure 5D:
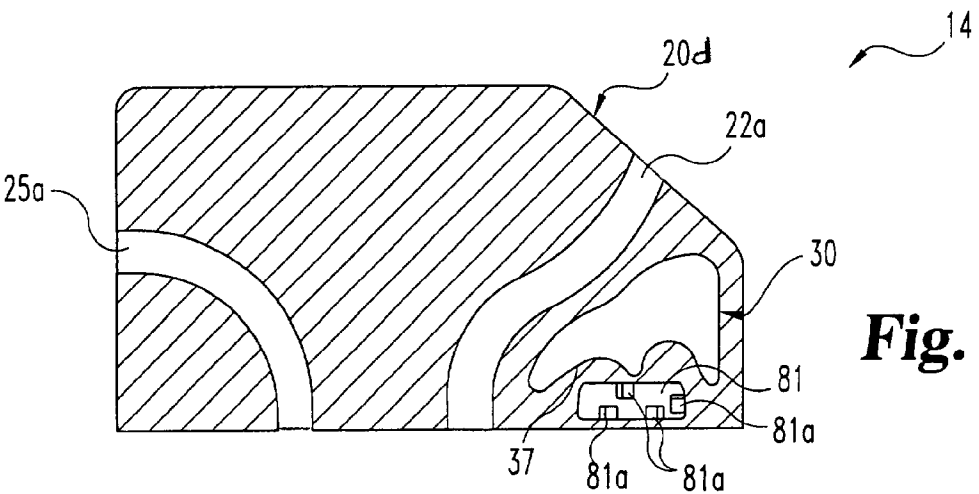
FIG. 5D is a cross-sectional view of the cylinder head of FIG. 5A taken along line 5D—5D of FIG. 5A.
Figure 6A:
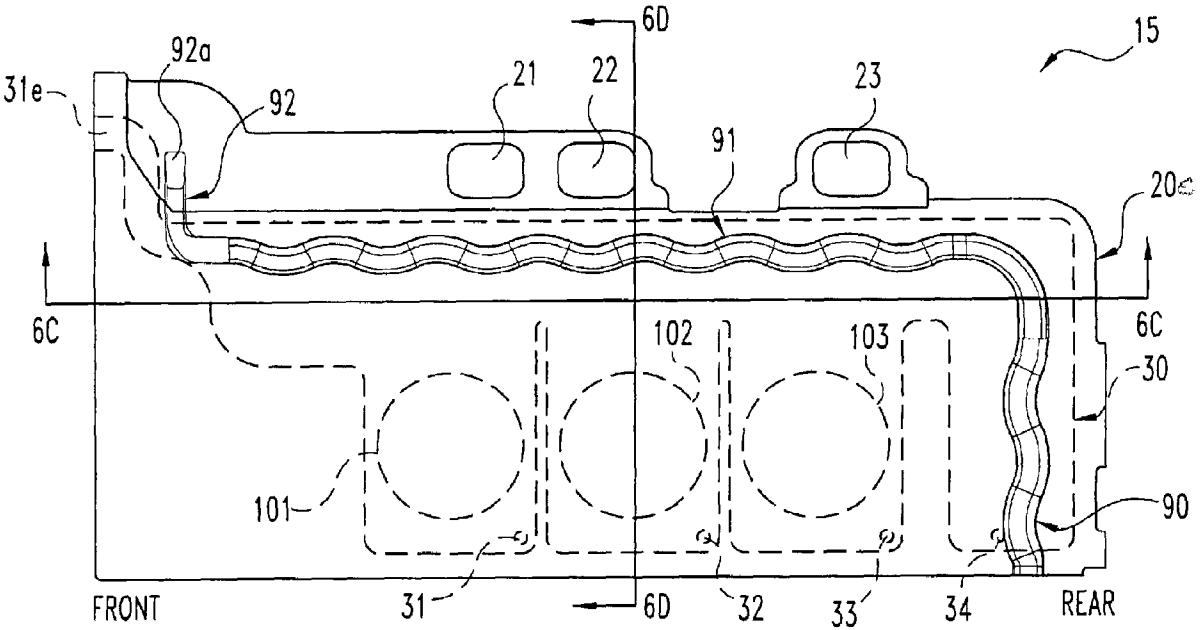
FIG. 6A is an illustrative side elevational view of an internal combustion engine comprising a cylinder head with a gas recirculation passage according to another form of the present invention.
Figure 6B:
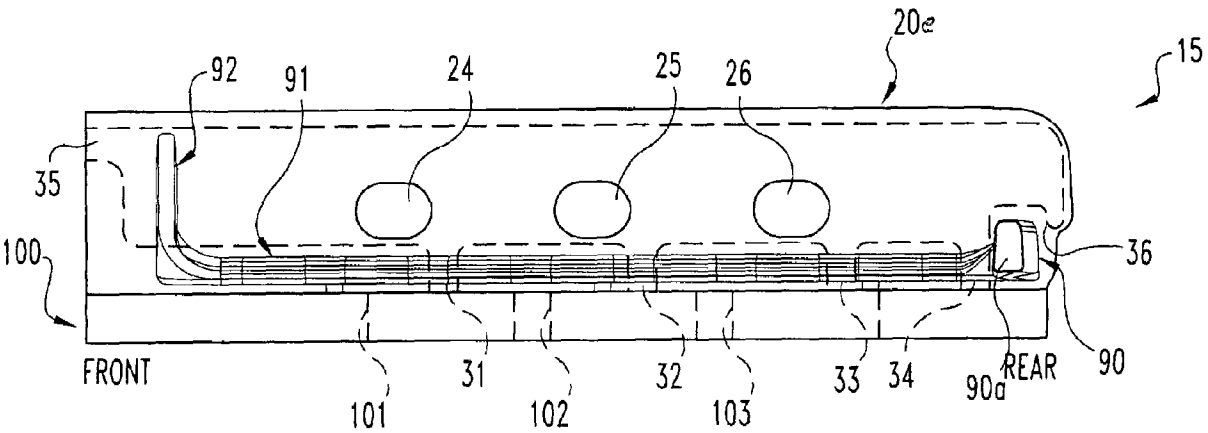
FIG. 6B is an illustrative bottom side view of the cylinder head comprising a portion of the FIG. 6A internal combustion engine.
Figure 6C:
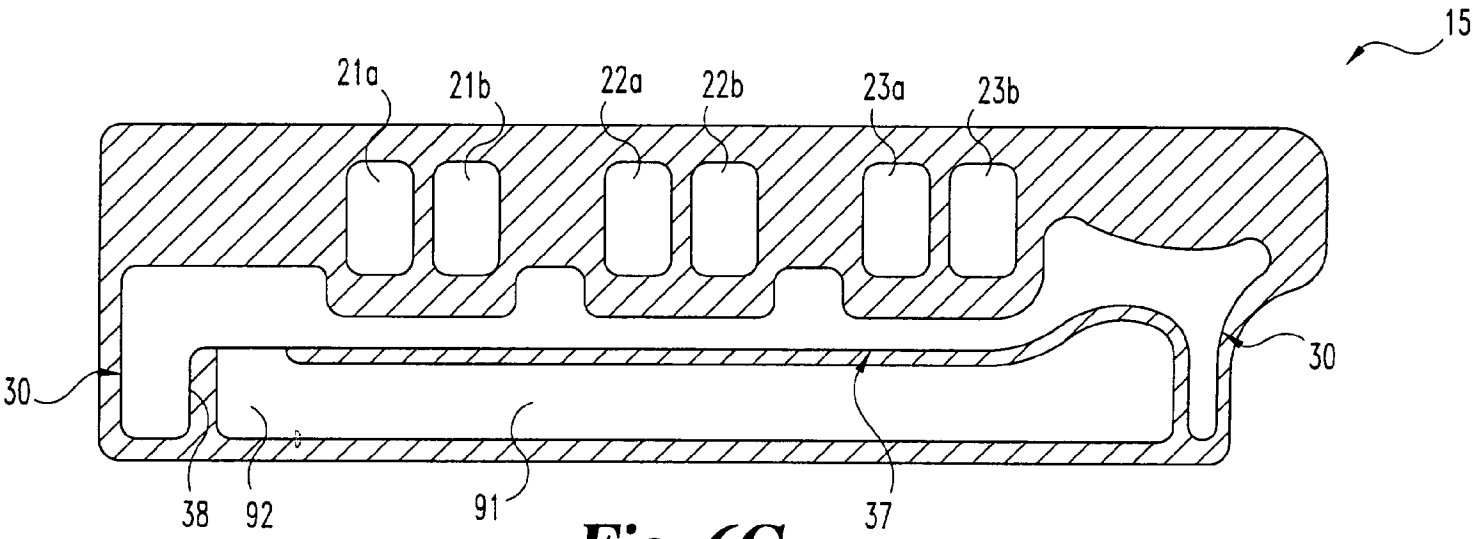
FIG. 6C is a cross-sectional view of the cylinder head of FIG. 6A taken along line 6C—6C of FIG. 6A.
Figure 6D:
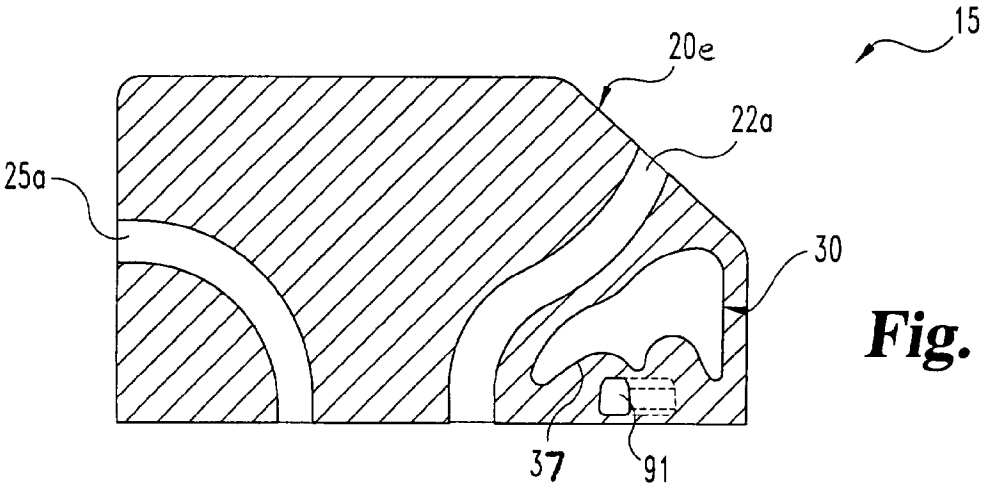
FIG. 6D is a cross-sectional view of the cylinder head of FIG. 6A taken along line 6D—6D of FIG. 6A.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With reference to FIGS. 1A–1D, there is illustrated an internal combustion engine cylinder head 20 with an exhaust gas recirculation passage therein of one form of the present invention. The cylinder head 20 is removably coupled to an engine block 100 by a plurality of head bolts (not illustrated). The internal combustion engine is generally of a conventional nature and includes intake and exhaust manifolds. Components of the internal combustion engine 10 relevant to the description of the present invention are described herein, while a description of the remaining components of the internal combustion engine as would occur to one skilled in the art are omitted for simplicity in describing the present invention. The term internal combustion engine is read broadly herein and is intended to include spark ignition and compression ignition engines. There is no limitation intended herein on the engine configuration unless specifically provided to the contrary; for example a "V" design vs. an inline design, displacement, compression ratio, overhead cam vs. push rod configuration, valves per cylinder, number of cylinders, fuel delivery, naturally aspirated vs. supercharged/turbocharged.

Cylinder head 20 includes a plurality of intake passages that have an inlet end in fluid flow communication with an intake manifold and an outlet end in fluid flow communication with the cylinders defined within the engine block 100. In a preferred form of the present invention an intake ducting system is formed within the cylinder head 20. The intake ducting system includes a first inlet port 21 disposed in flow communication with intake passages 21*a* and 21*b* and further in flow communication with cylinder 101. Further, the invention illustrated in FIGS. 1A–1D, includes an intake port 22 disposed in flow communication with intake passages 22*a* and 22*b* and further in flow communication with the cylinder 102, and an intake port 23 disposed in flow communication with intake passages 23*a* and 23*b* and further in flow communication with cylinder 103. The internal combustion engine in the figures is a "V" type engine, however other configurations such as, but not limited to inline engines are contemplated herein. One form of the present invention contemplates a "V" type internal combustion engine with three cylinders in flow communication with each cylinder head. The intake ducting system including ports 21, 22 and 23 deliver a fluid between the intake manifold and through the respective intake passages 21*a*, 21*b*, 22*a*, 22*b*, 23*a*, and 23*b* to the plurality of cylinders. Each of the plurality of cylinders has a piston moveable thereon, and valves for controlling the passage of fluid into an out of the cylinders. FIG. 1A, illustrates in phantom lines three cylinders 101, 102, and 103 respectively.

Cylinder head 20 includes an exhaust ducting system that includes a plurality of exhaust ports adapted to be coupled to and in flow communication with an exhaust manifold. In one form of the present invention the exhaust ducting system of cylinder head 20 includes: an exhaust port 24 having a pair of exhaust passages (not illustrated) in fluid communication with cylinder 101; an exhaust port 25 having a pair of exhaust passages (not illustrated) in fluid communication with cylinder 102; and, an exhaust port 26 having a pair of exhaust passages (not illustrated) in fluid communication with cylinder 103. The exhaust ducting system provides an exhaust gas discharge path from the plurality of cylinders to an exhaust manifold (not shown) that is coupled to the engine.

The internal combustion engine 10 includes a cooling system that circulates coolant through the engine block 100 and cylinder head 20. The coolant circulates through the engine block 100, cylinder head 20 and passes through a radiator to release heat absorbed from the engine. Cylinder head 20 includes a water jacket 30 positioned within cylinder head 20. One configuration of the water jacket is illustrated in FIGS. 1A–1D, however other water jacket configurations are contemplated herein. In a preferred form of the present invention the water jacket 30 is integrally cast within the cylinder head 20. However, the present invention further contemplates that the water jacket could be formed within the cylinder head by other means, such as but not limited to machining and/or the fabrication from multiple subcomponents. Water jacket 30 is in flow communication with a water jacket positioned within engine block 100. In a preferred form off the present invention the cylinder head 20 has a plurality of water jacket inlets along a bottomside surface that allow the passage of coolant from the engine block water jacket into the cylinder head water jacket 30.

The cylinder head 20 in FIGS. 1A–1D, includes an inlet opening 31, an inlet opening 32, an inlet opening 33, and an inlet opening 34 that are accessible along a bottomside surface of cylinder head 20. In alternative embodiments of the present invention the water jacket may contain a different quantity of inlet openings and the inlet openings can be located at different locations along the cylinder head. Water jacket 30 includes an outlet opening 35 accessible along a frontside surface of cylinder head 20 that is disposed in fluid flow communication with radiator. In alternative embodiments of the present invention the water jacket may include additional outlet openings and/or the outlet openings can be accessible along a different side of cylinder head 20.

The present invention contemplates an exhaust gas recirculation passage formed within the cylinder head 20 and adapted to deliver a quantity of exhaust gas from the exhaust portion of the engine to the intake portion of the engine. In one form of the present invention the exhaust gas recirculation passage includes a flow passage portion 40, a flow passage portion 41, a flow passage portion 42, and a flow passage portion 43 that are in flow communication with one another. The exhaust gas recirculation passage defines a fluid tight passageway between an inlet end and an outlet end. The exhaust gas recirculation passage is located within the cylinder head 20, but the passage is illustrated in the figures with solid lines to facilitate a clearer understanding of the flow passages 40–43. Preferably, the cylinder head 20 is an integral casting with the fluid flow passages 40–43 formed therein, however, the fluid flow passages 40–43 could be provided by other techniques appropriate for allowing fluid flow within a cylinder head.

The exhaust gas recirculation passage has an inlet opening 40*a* in fluid communication with an exhaust manifold (not illustrated) or an exhaust gas recirculation valving system. Both of the exhaust manifold and the valving system are configured to provide a quantity of exhaust gas to the inlet opening 40*a*. The exhaust gas recirculation passage includes an outlet opening 43*a* accessible along an intake surface of the cylinder head 20 and adapted to discharge the exhaust gas into the intake manifold. In one from of the present invention the flow passage portion 40 extends substantially along a longitudinal axis (not shown) that is substantially parallel to the intake passages 21–23, exhaust passages 24–26, and the front end and the rear end of cylinder head 20. In an alternative embodiment of the present invention the flow passage portion 40 does not extend along a longitudinal axis that is parallel to intake passages 21–23, exhaust passages 24–26, the front end of cylinder head 20, and/or the rear end of cylinder head 20. A wall member 36 that is disposed between the water jacket 30 and the flow passage portion 40 defines a portion of the cylinder head 20. Passage of coolant through the water jacket 30 and hot exhaust gas through the flow passage portion 40 causes heat transfer through the wall member 36. In one form of the present invention the flow passage portion 40 includes a plurality of fins 40*b* located therein for enhancing the transfer of heat between the exhaust gas and the wall member defining the passage The flow passage portion 41 extending along the length of the cylinder head 20 from the rear of the cylinder head to the front of the cylinder head. In one embodiment the flow passage portion 41 has a longitudinal axis (not shown) that is substantially perpendicular to intake passages 21–23, exhaust passages 24–26, and the front end and the rear end of cylinder head 20. In an alternative embodiment of the present invention the flow passage portion 41 has a longitudinal axis that is not oriented perpendicular to intake passages 21–23, exhaust passages 24–26, the front end of cylinder head 20, and/or the rear end of cylinder head 20. Flow passage portion 41 is disposed in fluid communication with the flow passage portion 40. Cylinder head 20 includes a wall member 37 that defines a portion of the water jacket 30 and is disposed adjacent the flow passage portion 41. There is heat transfer through the wall member 37 between the fluid flowing within water jacket 30 and the flow passage portion 41. In an alternate embodiment the flow passage portion 41 includes a plurality of heat transfer member 41*a* extending into the flow passage portion for enhancing the heat transfer between the fluids.

In one embodiment flow passage portion 42 has a longitudinal axis (not shown) that is substantially perpendicular to intake passages 21–23, exhaust passages 24–26, and the front end and the rear end of cylinder head 20. In alternative embodiments of the flow passage portion 42 the longitudinal axis of the passage 42 is not perpendicular to intake passages 21–23, exhaust passages 24–26, the front end of cylinder head 20, and/or the rear end of cylinder head 20. In one embodiment of the present invention the longitudinal axis of the flow passage portion 41 and the flow passage portion 42 are substantially parallel. In alternative embodiments of the flow passage portion 42, the longitudinal axis of passage portion 41 and passage portion 42 are not parallel. In one form of the present invention three (3) support members 44 are affixed to the outer surface of flow passage portion 41 and flow passage portion 42 and are connected to the cylinder head. Flow passage portion 42 is disposed in fluid communication with the flow passage portion 40. Wall member 37 is adjacent the flow passage portion 42 and heat transfer occurs through the wall member between the fluid flowing within the water jacket 30 and the fluid flowing within the flow passage portion 42. In an alternate embodiment flow passage portion 42 includes a plurality of internal fins for enhancing the transfer of heat between the exhaust gas and the wall structure.

In one embodiment flow passage portion 43 has a longitudinal axis (not shown) that is substantially parallel to intake passages 21–23, exhaust passages 24–26, and the front end and the rear end of cylinder head 20. In alternative embodiments of flow passage portion 43, the longitudinal axis of flow passage portion 43 is not parallel to intake passages 21–23, exhaust passages 24–26, the front end of cylinder head 20, and/or the rear end of cylinder head 20. The flow passage portion 43 is in fluid communication with flow passage portion 41 and flow passage portion 42. The outlet opening 43*a* of the flow passage portion 43 is accessible along an intake side surface of cylinder head 20 and is in fluid communication with the intake manifold (not shown) or an exhaust gas recirculation valve block (not shown). In either structure the exhaust gas is delivered into the intake manifold. The cylinder head 20 includes a wall member 38 between the water jacket 30 and the flow passage portion 43. The exchange of energy occurs through the wall member 38 and functions to transfer heat between the exhaust gas and the coolant. In an alternate embodiment the flow passage portion includes a plurality of members therein for enhancing the transfer of heat between the fluids.

With reference to FIGS. 2A–2D, there is illustrated an internal combustion engine 11 with a cylinder head 20*a* having an alternate embodiment of the gas recirculation passage of the present invention. Cylinder head 20*a* is substantially similar to the previously described cylinder head 20. Like feature numbers will be utilized to describe substantially identical features. The present invention contemplates an alternate embodiment of the exhaust gas recirculation passage formed within the cylinder head 20*a* and adapted to deliver a quantity of exhaust gas from the exhaust portion of the engine to the intake portion of the engine. In one form of the present invention the exhaust gas recirculation passage includes a flow passage portion 50, a flow passage portion 51, and a flow passage portion 52 that are in flow communication with one another. The exhaust gas recirculation passage defines a fluid tight passageway between an inlet end and an outlet end. The exhaust gas recirculation passage is located within the cylinder head 20*a*, but the passage is illustrated in the figures with solid lines to facilitate a clearer understanding of the flow passages 50–52. Preferably, the cylinder head 20*a* is an integral casting with the fluid flow passages 50–52 formed therein, however, the fluid flow passages 50–52 could be provided by other techniques appropriate for allowing fluid flow within a cylinder head.

The exhaust gas recirculation passage has an inlet opening 50*a* in fluid communication with an exhaust manifold (not illustrated) or an exhaust gas recirculation valving system. Both of the exhaust manifold and the valving system are configured to provide a quantity of exhaust gas to the inlet opening 50*a*. The exhaust gas recirculation passage includes an outlet opening 52*a* accessible along an intake surface of the cylinder head 20*a* and adapted to discharge the exhaust gas into the intake manifold. In one from of the present invention the flow passage portion 50 extends substantially along a longitudinal axis (not shown) that is substantially parallel to the intake passages 21–23, exhaust passages 24–26, and the front end and the rear end of cylinder head 20*a*. In an alternative embodiment of the present invention the flow passage portion 50 does not extend along a longitudinal axis that is parallel to intake passages 21–23, exhaust passages 24–26, the front end of cylinder head 20*a*, and/or the rear end of cylinder head 20*a*. A wall member 36 that is disposed between the water jacket 30 and the flow passage portion 50 defines a portion of the cylinder head 20*a*. Passage of coolant through the water jacket 30 and hot exhaust gas through the flow passage portion 50 cause heat transfer through the wall member 36. In one form of the present invention the flow passage portion 50 includes a plurality of fins located therein for enhancing the transfer of heat between the exhaust gas and the wall member defining the passage. In an alternate form of the present invention the flow passage portion 50 includes no heat transfer members within its interior flow path.

The flow passage portion 51 extends along the length of the cylinder head 20*a* from the rear of the cylinder head to the front of the cylinder head. In one embodiment the flow passage portion 51 has a longitudinal axis (not shown) that is substantially perpendicular to intake passages 21–23, exhaust passages 24–26, and the front end and the rear end of cylinder head 20*a*. In an alternative embodiment of the present invention the flow passage portion 51 has a longitudinal axis that is not oriented perpendicular to intake passages 21–23, exhaust passages 24–26, the front end of cylinder head 20*a*, and/or the rear end of cylinder head 20*a*. Flow passage portion 51 is disposed in fluid communication with the flow passage portion 50. Cylinder head 20*a* includes a wall member 37 that defines a portion of the water jacket 30 and is disposed adjacent the flow passage portion 51. There is heat transfer through the wall member 37 between the fluid flowing within water jacket 30 and the flow passage portion 51. In an alternate embodiment the flow passage portion 51 includes a plurality of heat transfer members that extend into the flow passage portion for enhancing the heat transfer between the fluids.

In one form flow passage portion 52 has a longitudinal axis (not shown) that is substantially parallel to intake passages 21–23, exhaust passages 24–26, and the front end and the rear end of cylinder head 20*a*. In alternative embodiments of flow passage portion 52, the longitudinal axis of flow passage portion 52 is not parallel to intake passages 21–23, exhaust passages 24–26, the front end of cylinder head 20*a*, and/or the rear end of cylinder head 20*a*. The flow passage portion 52 is in fluid communication with flow passage portion 51. The outlet opening 52*a* of the flow passage portion 52 is accessible along an intake side surface of cylinder head 20*a* and is in fluid communication with the intake manifold (not shown) or an exhaust gas recirculation valve block (not shown). In either structure the exhaust gas is delivered into the intake manifold. The cylinder head 20*a* includes a wall member 38 between the water jacket 30 and the flow passage portion 52. The exchange of energy occurs through the wall member 38 and functions to transfer heat between the exhaust gas and the coolant. In an alternate embodiment the flow passage portion includes a plurality of members therein for enhancing the transfer of heat between the fluids.

With reference to FIGS. 3A–3D, there is illustrated an internal combustion engine 12 with a cylinder head 20*b* having an alternate embodiment of the gas recirculation passage of the present invention. Cylinder head 20*b* is substantially similar to the previously described cylinder heads. Like feature numbers will be utilized to describe substantially identical features. The present invention contemplates an exhaust gas recirculation passage formed within the cylinder head 20*b* and adapted to deliver a quantity of exhaust gas from the exhaust portion of the engine to the intake portion of the engine. In one form of the present invention the exhaust gas recirculation passage includes a serpentine flow passage portion 60, a flow passage portion 61, a flow passage portion 62, and a flow passage portion 63 that are in flow communication with one another. The exhaust gas recirculation passage defines a fluid tight passageway between an inlet end and an outlet end. The exhaust gas recirculation passage is located within the cylinder head 20*b*, but the passage is illustrated in the figures with solid lines to facilitate a clearer understanding of the flow passages 60–63. Preferably, the cylinder head 20*b* is an integral casting with the fluid flow passages 60–63 formed therein, however, the fluid flow passages 60–63 could be provided by other techniques appropriate for allowing fluid flow within a cylinder head.

The exhaust gas recirculation passage has an inlet opening 60*a* in fluid communication with an exhaust manifold (not illustrated) or an exhaust gas recirculation valving system. Both of the exhaust manifold and the valving system are configured to provide a quantity of exhaust gas to the inlet opening 60*a*. The exhaust gas recirculation passage includes an outlet opening 63*a* accessible along an intake surface of the cylinder head 20*b* and adapted to discharge the exhaust gas into the intake manifold. In one from of the present invention the flow passage portion 60 defines a serpentine passageway that extends, in the macro sense, substantially along a longitudinal axis (not shown) that is substantially parallel to the intake passages 21–23, exhaust passages 24–26, and the front end and the rear end of cylinder head 20*b*. In an alternative embodiment of the present invention the flow passage portion 60 does not extend along a longitudinal axis that is parallel to intake passages 21–23, exhaust passages 24–26, the front end of cylinder head 20*b*, and/or the rear end of cylinder head 20*b*. A wall member 36 that is disposed between the water jacket 30 and the flow passage portion 60 defines a portion of the cylinder head 20*b*. Passage of coolant through the water jacket 30 and hot exhaust gas through the flow passage portion 60 causes heat transfer through the wall member 36. In one form of the present invention the flow passage portion 60 includes a plurality of fins located therein for enhancing the transfer of heat between the exhaust gas and the wall member defining the passage. In an alternate form of the present invention the flow passage portion 60 includes no heat transfer members within its internal flow path.

The flow passage portion 61 extends along the length of the cylinder head 20*b* from the rear of the cylinder head to the front of the cylinder head. In one embodiment the flow passage portion 61 has a longitudinal axis (not shown) that is substantially perpendicular to intake passages 21–23, exhaust passages 24–26, and the front end and the rear end of cylinder head 20*b*. In an alternative embodiment of the present invention the flow passage portion 61 has a longitudinal axis that is not oriented perpendicular to intake passages 21–23, exhaust passages 24–26, the front end of cylinder head 20*b*, and/or the rear end of cylinder head 20*b*. Flow passage portion 61 is disposed in fluid communication with the flow passage portion 60. Cylinder head 20*b* includes a wall member 37 that defines a portion of the water jacket 30 and is disposed adjacent the flow passage portion 61. There is heat transfer through the wall member 37 between the fluid flowing within water jacket 30 and the flow passage portion 61. In one embodiment the flow passage portion 61 includes a plurality of heat transfer member 61*a* that extend into the flow passage portion for enhancing the heat transfer between the fluids. In an alternate embodiment the flow passage portion 61 does not include any heat transfer members extending into the flow passage portion.

In one embodiment flow passage portion 62 has a longitudinal axis (not shown) that is substantially perpendicular to intake passages 21–23, exhaust passages 24–26, and the front end and the rear end of cylinder head 20*b*. In alternative embodiments of the flow passage portion 62 the longitudinal axis of the passage 62 is not perpendicular to intake passages 21–23, exhaust passages 24–26, the front end of cylinder head 20*b*, and/or the rear end of cylinder head 20*b*. In one embodiment of the present invention the longitudinal axis of flow passage portion 61 and flow passage portion 62 are substantially parallel. In alternative embodiments of the flow passage portion 62, the longitudinal axis of passage portion 61 and passage portion 62 are not parallel. In one form of the present invention three (3) support members 64 are affixed to the outer surface of flow passage portion 61 and flow passage portion 62 and are connected to the cylinder head 20*b*. Flow passage portion 62 is disposed in fluid communication with the flow passage portion 60. Wall member 37 is adjacent the flow passage portion 62 and heat transfer occurs through the wall member between the fluid flowing within the water jacket 30 and the fluid flowing within the flow passage portion 62. In an alternate embodiment flow passage portion 62 includes a plurality of internal fins for enhancing the transfer of heat between the exhaust gas and the wall structure.

In one embodiment flow passages portion 63 has a longitudinal axis (not shown) that is substantially parallel to intake passages 21–23, exhaust passages 24–26, and the front end and the rear end of cylinder head 20*b*. In alternative embodiments of flow passage portion 63, the longitudinal axis of flow passage portion 63 is not parallel to intake passages 21–23, exhaust passages 24–26, the front end of cylinder head 20*b*, and/or the rear end of cylinder head 20*b*. The flow passage portion 63 is in fluid communication with flow passage portion 61 and flow passage portion 62. The outlet opening 63*a* of the flow passage portion 63 is accessible along an intake side surface of cylinder head 20*b* and is in fluid communication with the intake manifold (not shown) or an exhaust gas recirculation valve block (not shown). In either structure the exhaust gas is delivered into the intake manifold. The cylinder head 20*b* includes a wall member 38 located between the water jacket 30 and the flow passage portion 63. The exchange of energy occurs through the wall member 38 and functions to transfer heat between the exhaust gas and the coolant. In an alternate embodiment the flow passage portion includes a plurality of members therein for enhancing the transfer of heat between the fluids.

With reference to FIGS. 4A–4D, there is illustrated an internal combustion engine 13 with a cylinder head 20*c* having an alternate embodiment of the gas recirculation passage of the present invention. Cylinder head 20*c* is substantially similar to the previously described cylinder heads. Like feature numbers will be utilized to describe substantially identical features. The present invention contemplates an exhaust gas recirculation passage formed within the cylinder head 20*c* and adapted to deliver a quantity of exhaust gas from the exhaust portion of the engine to the intake portion of the engine. In one form of the present invention the exhaust gas recirculation passage includes a flow passage portion 70, a flow passage portion 71 and a flow passage portion 72 that are in flow communication with one another. The exhaust gas recirculation passage defines a fluid tight passageway between an inlet end and an outlet end. The exhaust gas recirculation passage is located within the cylinder head 20*c*, but the passage is illustrated in the figures with solid lines to facilitate a clearer understanding of the flow passages 70–72. Preferably, the cylinder head 20*c* is an integral casting with the fluid flow passages 70–72 formed therein, however, the fluid flow passages 70–72 could be provided by other techniques appropriate for allowing fluid flow within a cylinder head.

The exhaust gas recirculation passage has an inlet opening 70*a* in fluid communication with an exhaust manifold (not illustrated) or an exhaust gas recirculation valving system. Both of the exhaust manifold and the valving system are configured to provide a quantity of exhaust gas to the inlet opening 70*a*. The exhaust gas recirculation passage includes an outlet opening 72*a* accessible along an intake surface of the cylinder head 20*c* and adapted to discharge the exhaust gas into the intake manifold. In one from of the present invention the flow passage portion 70 extends substantially along a longitudinal axis (not shown) that is substantially parallel to the intake passages 21–23, exhaust passages 24–26, and the front end and the rear end of cylinder head 20*c*. In an alternative embodiment of the present invention the flow passage portion 70 does not extend along a longitudinal axis that is parallel to intake passages 21–23, exhaust passages 24–26, the front end of cylinder head 20*c*, and/or the rear end of cylinder head 20*c*. A wall member 36 that is disposed between the water jacket 30 and the flow passage portion 70 defines a portion of the cylinder head 20*c*. Passage of coolant through the water jacket 30 and hot exhaust gas through the flow passage portion 70 cause heat transfer through the wall member 36. In one form of the present invention the flow passage portion 70 includes a plurality of fins located therein for enhancing the transfer of heat between the exhaust gas and the wall member defining the passage. In an alternate embodiment of the present invention the flow passage portion 70 includes no heat transfer members within the internal flow path.

The flow passage portion 71 extends along the length of the cylinder head 20*c* from the rear of the cylinder head to the front of the cylinder head. In one embodiment the flow passage portion 71 has a longitudinal axis (not shown) that is substantially perpendicular to intake passages 21–23, exhaust passages 24–26, and the front end and the rear end of cylinder head 20*c*. In an alternative embodiment of the present invention the flow passage portion 71 has a longitudinal axis that is not oriented perpendicular to intake passages 21–23, exhaust passages 24–26, the front end of cylinder head 20*c*, and/or the rear end of cylinder head 20*c*. Flow passage portion 71 is disposed in fluid communication with the flow passage portion 70. Cylinder head 20*c* includes a wall member 37 that defines a portion of the water jacket 30 and is disposed adjacent the flow passage portion 71. There is heat transfer through the wall member 37 between the fluid flowing within water jacket 30 and the flow passage portion 71. In an alternate embodiment the flow passage portion 71 includes a plurality of heat transfer member 71*a* extending into the flow passage portion for enhancing the heat transfer between the fluids.

In one embodiment flow passage portion 72 has a longitudinal axis (not shown) that is substantially parallel to intake passages 21–23, exhaust passages 24–26, and the front end and the rear end of cylinder head 20*c*. In alternative embodiments of flow passage portion 72, the longitudinal axis of flow passage portion 72 is not parallel to intake passages 21–23, exhaust passages 24–26, the front end of cylinder head 20*c*, and/or the rear end of cylinder head 20*c*. The flow passage portion 72 is in fluid communication with flow passage portion 71. The outlet opening 72*a* of the flow passages portion 72 is accessible along an intake side surface of cylinder head 20*c* and is in fluid communication with the intake manifold (not shown) or an exhaust gas recirculation valve block (not shown). In either structure the exhaust gas is delivered into the intake manifold. The cylinder head 20*c* includes a wall member 38 between the water jacket 30 and the flow passage portion 72. The exchange of energy occurs through the wall member 38 and functions to transfer heat between the exhaust gas and the coolant. In an alternate embodiment the flow passage portion includes a plurality of members therein for enhancing the transfer of heat between the fluids.

With reference to FIGS. 5A–5D, there is illustrated an internal combustion engine 14 with a cylinder head 20*d* having an alternate embodiment of the gas recirculation passage of the present invention. Cylinder head 20*d* is substantially similar to the previously described cylinder heads. Like feature numbers will be utilized to describe substantially identical features. The present invention contemplates an exhaust gas recirculation passage formed within the cylinder head 20*d* and adapted to deliver a quantity of exhaust gas from the exhaust portion of the engine to the intake portion of the engine. In one form of the present invention the exhaust gas recirculation passage includes a flow passage portion 80, a flow passage portion 81 and a flow passage portion 82 that are in flow communication with one another. The exhaust gas recirculation passage defines a fluid tight passageway between an inlet end and an outlet end. The exhaust gas recirculation passage is located within the cylinder head 20*d*, but the passage is illustrated in the figures with solid lines to facilitate a clearer understanding of the flow passages 80–82. Preferably, the cylinder head 20*d* is an integral casting with the fluid flow passages 80–82 formed therein, however, the fluid flow passages 80–82 could be provided by other techniques appropriate for allowing fluid flow within a cylinder head.

The exhaust gas recirculation passage has an inlet opening 80*a* in fluid communication with an exhaust manifold (not illustrated) or an exhaust gas recirculation valving system. Both of the exhaust manifold and the valving system are configured to provide a quantity of exhaust gas to the inlet opening 80*a*. The exhaust gas recirculation passage includes an outlet opening 82*a* accessible along an intake surface of the cylinder head 20*d* and adapted to discharge the exhaust gas into the intake manifold. In one from of the present invention the flow passage portion 80 extends substantially along a longitudinal axis (not shown) that is substantially parallel to the intake passages 21–23, exhaust passages 24–26, and the front end and the rear end of cylinder head 20*d*. In an alternative embodiment of the present invention the flow passage portion 80 does not extend along a longitudinal axis that is parallel to intake passages 21–23, exhaust passages 24–26, the front end of cylinder head 20*d*, and/or the rear end of cylinder head 20*d*. A wall member 36 that is disposed between the water jacket 30 and the flow passage portion 80 defines a portion of the cylinder head 20*d*. Passage of coolant through the water jacket 30 and hot exhaust gas through the flow passage portion 80 causes heat transfer through the wall member 36. In one form of the present invention the flow passage portion 80 includes a plurality of fins 80*a* located therein for enhancing the transfer of heat between the exhaust gas and the wall member defining the passage. In an another form of the present invention the flow passage portion 80 includes no fins/members within its internal flow path.

The flow passage portion 81 extends along the length of the cylinder head 20*d* from the rear of the cylinder head to the front of the cylinder head. In one embodiment the flow passage portion 81 has a longitudinal axis (not shown) that is substantially perpendicular to intake passages 21–23, exhaust passages 24–26, and the front end and the rear end of cylinder head 20*d*. In an alternative embodiment of the present invention the flow passage portion 81 has a longitudinal axis that is not oriented perpendicular to intake passages 21–23, exhaust passages 24–26, the front end of cylinder head 20*d*, and/or the rear end of cylinder head 20*d*. Flow passage portion 81 is disposed in fluid communication with the flow passage portion 80. Cylinder head 20*d* includes a wall member 37 that defines a portion of the water jacket 30 and is disposed adjacent the flow passage portion 81. There is heat transfer through the wall member 37 between the fluid flowing within water jacket 30 and the flow passage portion 81. In one embodiment the flow passage portion 81 includes a plurality of heat transfer member 81*a* extending into the flow passage portion for enhancing the heat transfer between the fluids. In an alternate embodiment the flow passage 81 does not include heat transfer members extending into the passage.

In one embodiment flow passage portion 82 has a longitudinal axis (not shown) that is substantially parallel to intake passages 21–23, exhaust passages 24–26, and the front end and the rear end of cylinder head 20*d*. In alternative embodiments of flow passage portion 82, the longitudinal axis of flow passage portion 82 is not parallel to intake passages 21–23, exhaust passages 24–26, the front end of cylinder head 20*d*, and/or the rear end of cylinder head 20*d*. The flow passage portion 82 is in fluid communication with flow passage portion 81. The outlet opening 82*a* of the flow passages portion 82 is accessible along an intake side surface of cylinder head 20*d* and is in fluid communication with the intake manifold (not shown) or an exhaust gas recirculation valve block (not shown). In either structure the exhaust gas is delivered into the intake manifold. The cylinder head 20*d* includes a wall member 38 between the water jacket 30 and the flow passage portion 82. The exchange of energy occurs through the wall member 38 and functions to transfer heat between the exhaust gas and the coolant. In an alternate embodiment the flow passage portion includes a plurality of members therein for enhancing the transfer of heat between the fluids.

With reference to FIGS. 6A–6D, there is illustrated an internal combustion engine 15 with a cylinder head 20*e* having an alternate embodiment of the gas recirculation passage of the present invention. Cylinder head 20*e* is substantially similar to the previously described cylinder heads. Like feature numbers will be utilized to describe substantially identical features. The present invention contemplates an exhaust gas recirculation passage formed within the cylinder head 20*e* and adapted to deliver a quantity of exhaust gas from the exhaust portion of the engine to the intake portion of the engine. In one form of the present invention the exhaust gas recirculation passage includes a flow passage portion 90, a flow passage portion 91, and a flow passage portion 92 that are in flow communication with one another. The exhaust gas recirculation passage defines a fluid tight passageway between an inlet end and an outlet end. The exhaust gas recirculation passage is located within the cylinder head 20*e*, but the passage is illustrated in the figures with solid lines to facilitate a clearer understanding of the flow passages 90–92. Preferably, the cylinder head 20*e* is an integral casting with the fluid flow passages 90–92 formed therein, however, the fluid flow passages 90–92 could be provided by other techniques appropriate for allowing fluid flow within a cylinder head.

The exhaust gas recirculation passage has an inlet opening 90*a* in fluid communication with an exhaust manifold (not illustrated) or an exhaust gas recirculation valving system. Both of the exhaust manifold and the valving system are configured to provide a quantity of exhaust gas to the inlet opening 90*a*. The exhaust gas recirculation passage includes an outlet opening 92*a* accessible along an intake surface of the cylinder head 20*e* and adapted to discharge the exhaust gas into the intake manifold. In one from of the present invention the flow passage portion 90 is of a zigzag configuration and extends, in a macro sense, substantially along a longitudinal axis (not shown) that is substantially parallel to the intake passages 21–23, exhaust passages 24–26, and the front end and the rear end of cylinder head 20*e*. In an alternative embodiment of the present invention the flow passage portion 90 does not extend along a longitudinal axis that is parallel to intake passages 21–23, exhaust passages 24–26, the front end of cylinder head 20*e*, and/or the rear end of cylinder head 20*e*. A wall member 36 that is disposed between the water jacket 30 and the flow passage portion 90 defines a portion of the cylinder head 20*e*. Passage of coolant through the water jacket 30 and hot exhaust gas through the flow passage portion 90 causes heat transfer through the wall member 36. In one form of the present invention the flow passage portion 90 includes a plurality of fins located therein for enhancing the transfer of heat between the exhaust gas and the wall member defining the passage. In an alternate form of the present invention the flow passage portion 90 includes no fins within its internal flow path.

The flow passage portion 91 extends along the length of the cylinder head 20*e* from the rear of the cylinder head to the front of the cylinder head. In a preferred form of the present invention the flow path portion 91 forms a zigzag configuration or a serpentine configuration. In one embodiment the flow passage portion 91 has a longitudinal axis (not shown) that is substantially perpendicular in the macro sense to intake passages 21–23, exhaust passages 24–26, and the front end and the rear end of cylinder head 20*e*. In an alternative embodiment of the present invention the flow passage portion 91 has a longitudinal axis that is not oriented perpendicular to intake passages 21–23, exhaust passages 24–26, the front end of cylinder head 20*e*, and/or the rear end of cylinder head 20*e*. Flow passage portion 91 is disposed in fluid communication with the flow passage portion 90. Cylinder head 20*e* includes a wall member 37 that defines a portion of the water jacket 30 and is disposed adjacent the flow passage portion 91. There is heat transfer through the wall member 37 between the fluid flowing within water jacket 30 and the flow passage portion 91. In an alternate embodiment the flow passage portion 91 includes a plurality of heat transfer member 91 extending into the flow passage portion for enhancing the heat transfer between the fluids. In an alternate embodiment the flow passage portion 91 does not include any heat transfer members extending into the passage.

In one embodiment flow passage portion 92 has a longitudinal axis (not shown) that is substantially parallel to intake passages 21–23, exhaust passages 24–26, and the front end and the rear end of cylinder head 20*e*. In alternative embodiments of flow passages portion 92, the longitudinal axis of flow passage portion 92 is not parallel to intake passages 21–23, exhaust passages 24–26, the front end of cylinder head 20*e*, and/or the rear end of cylinder head 20*e*. The flow passage portion 92 is in fluid communication with flow passages portion 91. The outlet opening 92*a* of the flow passages portion 92 is accessible along an intake side surface of cylinder head 92 and is in fluid communication with the intake manifold (not shown) or an exhaust gas recirculation valve block (not shown). In either structure the exhaust gas is delivered into the intake manifold. The cylinder head 20*e* includes a wall member 38 between the water jacket 30 and the flow passage portion 92. The exchange of energy occurs through the wall member 38 and functions to transfer heat between the exhaust gas and the coolant. In an alternate embodiment the flow passage portion includes a plurality of members therein for enhancing the transfer of heat between the fluids.

All publications, patents, and patent applications cited in this specification are herein incorporated by reference as if each individual publication, patent, or patent application were specifically and individually indicated to be incorporated by reference and set forth in its entirety herein. While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected.

What is claimed is:

1. An apparatus, comprising:

a cast cylinder head for a multi-cylinder internal combustion engine having an internal water jacket and a first longitudinal axis extending from a first end of said cylinder head to a second end of said cylinder head, said cylinder head having an intake passage system formed in the cylinder head for the delivery of a gas to each combustion chamber defined in said cylinder head and an exhaust passage system formed in the cylinder head for the passage of an exhaust gas from each of the combustion chambers; and an exhaust gas recirculation passage formed within said cylinder head and having an inlet proximate said first end of said cylinder head for receiving a portion of the exhaust gas and an outlet proximate said second end of said cylinder head in flow communication with said intake passage system, said exhaust gas recirculation passage having a first passage portion extending along said internal water jacket between said first end of said cylinder head and said second end of said cylinder head and substantially parallel with said longitudinal axis, and said first passage portion is disposed in a heat transfer relationship with said internal water jacket.

2. The apparatus of claim 1, wherein said cylinder head having an integrally formed wall member defined between said water jacket and said first passage portion, and wherein heat transfer occurring through said wall member between a coolant flowing within said water jacket and the exhaust gas flowing within said first passage portion.

3. The apparatus of claim 1, wherein at least a part of said exhaust gas recirculation passage has a serpentine configuration.

4. The apparatus of claim 1, wherein said first passage portion has a zigzag configuration.

5. The apparatus of claim 1, wherein said cylinder head having an integrally formed wall member defined between said water jacket and said first passage portion, and wherein heat transfer occurring through said wall member between a coolant flowing within said water jacket and the exhaust gas flowing within said first passage portion;

wherein said cylinder head includes a first side spaced from a second side and an upper side spaced from a bottom side, and wherein said bottom side having said combustion chambers formed thereon, and wherein said exhaust gas recirculation passage inlet is formed in said first side and includes a second passage portion extending substantially across said cylinder head from said first side to said second side and along and in a heat transfer relationship with said water jacket;

which further includes a second longitudinal axis oriented perpendicular to said first longitudinal axis, and wherein said second passage portion extending substantially parallel to said second longitudinal axis; and wherein said exhaust gas recirculation passage includes a third passage portion extending substantially parallel with said second longitudinal axis and extending between said second passage portion and said outlet.

6. The apparatus of claim 1, wherein said cylinder head includes a first side spaced from a second side and an upper side spaced from a bottom side, and wherein said bottom side having said combustion chambers formed thereon; and wherein said exhaust gas recirculation passage inlet is formed in said first side and includes a second passage portion extending substantially across said cylinder head from said first side to said second side and along and in a heat transfer relationship with said water jacket.

7. The apparatus of claim 6, which further includes a second longitudinal axis oriented perpendicular to said first longitudinal axis, and wherein said second passage portion extending substantially parallel to said second longitudinal axis.

8. The apparatus of claim 7, wherein said exhaust gas recirculation passage includes a third passage portion extending substantially parallel with said second longitudinal axis and extending between said second passage portion and said outlet.

9. The apparatus of claim 8, wherein at least one of said passage portions includes heat transfer enhancement members and another of said passage portions is substantially free of heat transfer enhancement members.

10. An apparatus, comprising:

a cast cylinder head for a multi-cylinder internal combustion engine having-an internal water jacket and a first longitudinal axis extending from a first end of said cylinder head to a second end of said cylinder head, said cylinder head having an intake passage system formed in the cylinder head for the delivery of a gas to each combustion chamber defined in said cylinder head and an exhaust, passage system formed in the cylinder head for the passage of an exhaust gas from each of the combustion chambers, said cylinder head includes a first side spaced from a second side and an upper side spaced from a bottom side and wherein said bottom side having said combustion chambers formed thereon; and an exhaust gas recirculation passage formed within said cylinder head and having an inlet proximate said first end of said cylinder head for receiving a portion of the exhaust gas and an outlet proximate said second end of said cylinder head in flow communication with said intake passage system, said exhaust gas recirculation passage having a first passage portion extending along said internal water jacket between said first end of said cylinder head and said second end of said cylinder head and substantially parallel with said longitudinal axis, and said first passage portion is disposed in a heat transfer relationship with said internal water jacket, and wherein said exhaust gas recirculation passage inlet is formed in said first side and includes a second passage portion extending substantially across said cylinder head from said first side to said second side and along and in a heat transfer relationship with said water jacket.

11. The apparatus of claim 10, which further includes a second longitudinal axis oriented perpendicular to said first longitudinal axis, and wherein said second passage portion extending substantially parallel to said second longitudinal axis.

12. The apparatus of claim 11, wherein said exhaust gas recirculation passage includes a third passage portion extending substantially parallel with said second longitudinal axis and extending between said second passage portion and said outlet.

13. The apparatus of claim 10, wherein said first passage portion is disposed in said cylinder head between said combustion chambers and said second side of said cylinder head.

14. An apparatus, comprising:

a cast cylinder head for a multi-cylinder internal combustion engine having an internal water jacket and a first longitudinal axis extending from a first end of said cylinder head to a second end of said cylinder head, said cylinder head having an intake passage system formed in the cylinder head for the delivery of a gas to each combustion chamber defined in said cylinder head and an exhaust passage system formed in the cylinder head for the passage of an exhaust gas from each of the combustion chambers; and an exhaust gas recirculation passage formed within said cylinder head and having an inlet proximate said first end of said cylinder head for receiving a portion of the exhaust gas and an outlet proximate said second end of said cylinder head in flow communication with said intake passage system, said exhaust gas recirculation passage having a first passage portion extending along said internal water jacket between said first end of said cylinder head and said second end of said cylinder head and substantially parallel with said longitudinal axis, and said first passage portion is disposed in a heat transfer relationship with said internal water jacket, said exhaust gas recirculation passage includes a second passage portion substantially parallel with said first passage portion, and wherein said second passage portion extending along said internal water jacket between said first end of said cylinder head and said second end of said cylinder head, and wherein said second passage portion is disposed in heat transfer relationship with said internal water jacket.

15. An apparatus, comprising:

a cast cylinder head for a multi-cylinder internal combustion engine having an internal water jacket and a first longitudinal axis extending from a first end of said cylinder head to a second end of said cylinder head, said cylinder head having an intake passage system formed in the cylinder head for the delivery of a gas to each combustion chamber defined in said cylinder head and an exhaust passage system formed in the cylinder head for the passage of an exhaust gas from each of the combustion chambers; and an exhaust gas recirculation passage formed within said cylinder head and having an inlet proximate said first end of said cylinder head for receiving a portion of the exhaust gas and an outlet proximate said second end of said cylinder head in flow communication with said intake passage system, said exhaust gas recirculation passage having a first passage portion extending along said internal water jacket between said first end of said cylinder head and said second end of said cylinder head and substantially parallel with said longitudinal axis, and said first passage portion is disposed in a heat transfer relationship with said internal water jacket, at least a part of said exhaust gas recirculation passage includes a plurality of heat transfer members therein.

16. A cylinder head, comprising:

a cast metallic body member for a multi-cylinder internal combustion engine having an internal water jacket and a first longitudinal axis extending from a first end of said body member to a second end of said body member, said body member having an intake passage system formed in the body member for the delivery of a gas to each combustion chamber defined in a bottom side of said body member and an exhaust passage system formed in said body member for the passage of an exhaust gas from each of the combustion chambers, and said body member includes a first side spaced apart from a second side and an upper side spaced apart from a bottom side, and wherein said bottom side having said combustion chambers formed thereon; and exhaust gas recirculation means formed within said cylinder head for delivery of a portion of the exhaust gas to said intake passage system, and wherein said exhaust gas recirculation means includes an inlet formed in said first side and a fist passage extending along said internal water jacket between said first end of said cylinder head and said second end of said cylinder head and substantially parallel with said first longitudinal axis, and said exhaust gas recirculation means further includes a second passage extending substantially across said body member from said first side to said second side and along and in a heat transfer relationship with said water jacket.

17. The apparatus of claim 11, which further includes a second longitudinal axis oriented perpendicular to said first longitudinal axis, and wherein said second passage extending substantially parallel to said second longitudinal axis.

18. The apparatus of claim 11, wherein said exhaust gas recirculation means is integrally cast within said body member.

19. The apparatus of claim 18, wherein said exhaust gas recirculation means includes heat transfer enhancement means for increasing the heat transfer between said body member and the exhaust gas.

20. A cylinder head, comprising:

an elongated cast metallic member for a multi-cylinder internal combustion engine having an internal water jacket and a first longitudinal axis extending along the elongated member from a first end of said member to a second end of said member, said member having an intake passage system formed in the member for the delivery of a fluid to each combustion chamber in a bottom side of said member and an exhaust passage system formed in said member for the passage of an exhaust gas from each of the combustion chambers; and exhaust gas recirculation means formed within said cylinder head for delivery of a portion of the exhaust gas to said intake passage system, wherein said exhaust gas recirculation means includes at least two fluid flow passageways spaced apart and extending parallel with said first longitudinal axis.

21. The cylinder head of claim 20, wherein said exhaust gas recirculation means includes an inlet proximate said first end and an outlet proximate said second end.

22. The cylinder head of claim 20, wherein one passageway of said two fluid flow passageways includes heat transfer members extending into said one passageway.

* * * * *